US008707869B2

(12) United States Patent
Blandon et al.

(10) Patent No.: US 8,707,869 B2
(45) Date of Patent: Apr. 29, 2014

(54) CABLEWAY INSTALLATION

(75) Inventors: Noel Blandon, Bernin (FR); Christophe Tambourin, Mercure (FR)

(73) Assignee: Sommital (FR)

( * ) Notice: Subject to any disclaimer, the term of this patent is extended or adjusted under 35 U.S.C. 154(b) by 183 days.

(21) Appl. No.: 13/127,658

(22) PCT Filed: Nov. 4, 2009

(86) PCT No.: PCT/FR2009/052130

§ 371 (c)(1),
(2), (4) Date: Jul. 15, 2011

(87) PCT Pub. No.: WO2010/052426

PCT Pub. Date: May 14, 2010

(65) Prior Publication Data

US 2011/0259235 A1 Oct. 27, 2011

(30) Foreign Application Priority Data

Nov. 5, 2008 (FR) ..... 08 06170

(51) Int. Cl.
*B61B 7/00* (2006.01)

(52) U.S. Cl.
USPC ..... 104/112; 104/180; 104/173.2

(58) Field of Classification Search
USPC ..... 104/112, 173.2, 173.1, 180, 179
See application file for complete search history.

(56) References Cited

U.S. PATENT DOCUMENTS 3,089,064 A * 5/1963 Cotton De Bennetot ..... 361/147
5,038,128 A * 8/1991 Georgiev et al. ..... 335/290
6,431,078 B2 * 8/2002 Serrano ..... 104/91
7,002,319 B2 * 2/2006 Hinteregger ..... 320/110
7,408,474 B2 * 8/2008 Frazier et al. ..... 340/635
7,800,509 B2 * 9/2010 Frazier et al. ..... 340/635
8,047,137 B2 * 11/2011 Blandon et al. ..... 104/173.2
2001/0020429 A1 * 9/2001 Serrano ..... 104/91

(Continued)

FOREIGN PATENT DOCUMENTS

EP 0285527 10/1988
EP 0678433 A1 10/1995

(Continued)

OTHER PUBLICATIONS

International Search Report PCT/FR2009/052130; Aug. 18, 2010.

(Continued)

*Primary Examiner* — Jason C Smith
(74) *Attorney, Agent, or Firm* — Cantor Colburn LLP

(57) ABSTRACT

A cableway installation including a travel cable, a vehicle suspended therefrom, boarding and disembarking points, an aerial carrier configured to support and drive the travel cable, a mobile conductor disposed on the vehicle, a fixed conductor disposed on the aerial carrier adjacent to the travel cable and in an area proximate to at least one of the boarding and disembarking points, the fixed conductor including a first fixed contact element connected to a low voltage electric supply and a first plurality of flexible conductive contact wires extending from the fixed conductor along a longitudinal length of at least one side of the travel cable, where the mobile conductor is disposed so as to the contact the first plurality of flexible conductive contact wires and establish electrical contact with the first fixed contact element and with the low voltage electric supply when the vehicle is transported between the boarding and disembarking points.

9 Claims, 1 Drawing Sheet

(56) References Cited

U.S. PATENT DOCUMENTS

| | | | | |
|---|---|---|---|---|
| 2004/0041541 | A1* | 3/2004 | Hinteregger | 320/137 |
| 2005/0168028 | A1 | 8/2005 | Seibt | |
| 2006/0060104 | A1* | 3/2006 | Hinteregger | 104/180 |
| 2011/0259235 | A1* | 10/2011 | Blandon et al. | 104/112 |
| 2012/0103225 | A1* | 5/2012 | Gubler | 104/112 |

FOREIGN PATENT DOCUMENTS

| | | | |
|---|---|---|---|
| EP | 1396407 | A1 | 3/2004 |
| JP | 60-85080 | U | 6/1985 |
| WO | 2007135256 | A1 | 11/2007 |
| WO | WO 2007135256 | A1 * | 11/2007 |

OTHER PUBLICATIONS

Japanese Office Action issued Sep. 10, 2013 re: Japanese Application No. 2011-535153: citing: JP 2006-519725; JP S-60-85080, WO 2007/135256.

* cited by examiner

CABLEWAY INSTALLATION

TECHNICAL FIELD

The invention relates to a cableway installation.

BACKGROUND

A cableway installation allows passengers, usually skiers, to travel up slopes. At the current time several types exist. Particular mention is made of installations of drag lift, chair lift, gondola and cable-car type.

A cableway installation conventionally comprises an embarking point for passengers and a disembarking point connected by a travel cable supported by towers and having the form of a closed loop. Vehicles such as seats or cabins are suspended via a grip on a carrier or travel cable; the cable is supported by towers and is driven by means of pulleys to cause the vehicles to travel forward.

Cableway installations have to transport a large number of passengers at a high safety level.

If the cableway installation is of chairlift type, the vehicles are chairs which may or may not be detachable.

In the first case, each chair can be disengaged i.e. can be separated from the main travel cable when it comes alongside the embarking or disembarking point. The chair is then led onto a sidetrack on which the travel speed of the chair is more limited. The boarding or disembarking of passengers is therefore able to take place with greater safety, the comfort of use for passengers additionally being improved.

In the second case, if the chairs are not detachable, they remain on the cable even at the boarding and disembarking points. The complexity of this type of installation is therefore reduced since no detaching system is required.

In all cases, the chairs travel above the ground, generally at quite a height above the ground.

It must therefore be ensured that each passenger, and in particular children, cannot accidentally fall over or under the safety rail.

For this purpose it is known to use a retaining system such as the one described in document WO 2007/135256.

A retaining system of this type comprises a magnetic member arranged on each chair, cooperating with a magnetisable element worn by a passenger being transported on the chair, so as to retain the passenger when the chair is travelling outside a disembarking point and to release said passenger when the chair passes through the disembarking point.

The retaining system also comprises first electric coupling means electrically connected to the magnetic member and arranged on the chair, and second electric coupling means receiving an electric current and arranged at the disembarking point so as to cooperate with the first electric coupling means when the chair passes through said disembarking point.

The magnetic member is arranged to retain the passenger when it is not supplied with electric current, and to release the passenger when it receives an electric current.

In this way, it is ensured that the passenger equipped with the magnetisable element is retained on the chair. Risks of falling are therefore limited.

The second electric coupling means arranged at the disembarking point are formed of contact brushes.

The contact brushes conventionally used require proper positioning of the first electric coupling means, and hence of the chair, at the disembarking point. Said positioning can be obtained if the chairs are detachable. In this case, the swinging movements of the chairs are limited at the boarding and disembarking points where the chairs are detached.

On the other hand, this type of contact brush is more difficult to use in a cableway installation in which the chairlifts are not detachable. In this case, the swinging movements are relatively extensive and it is difficult to establish proper contact between the contact brushes and the first electric contact means. In addition, there is a possibility of deteriorating said contact means and the contact brushes.

Additionally, it may prove to be useful to deliver signals to the passengers, for example safety-related signals.

BRIEF SUMMARY

Within this technical context, the invention proposeS the sequential supplying of current to a vehicle of a cableway installation, in particular for a magnetic retaining system.

The invention concerns a cableway installation particularly comprising means for guiding and driving an aerial carrier and travel cable on which vehicles are suspended, and comprising at least one boarding point and at least one disembarking point. The cableway installation further comprises a device for supplying sequential current to a vehicle comprising a fixed electric conductor connected to a low voltage electric supply, comprising a plurality of flexible conductive contact wires arranged on at least one of the guiding and driving means of the aerial cable and a mobile conductor on-board the vehicle, allowing electric contact to be set up when the mobile conductor comes into contact with the contact wires of the fixed electric conductor.

With the invention it is therefore possible to ensure reliable, simple and low-cost electric supply to a vehicle of a cableway installation e.g. a chairlift or gondola when it passes in the vicinity of means guiding the carrier/travel cable of the vehicle under consideration, namely a tower or a pulley at a boarding or disembarking terminal. The fact that it is thus possible to ensure the point supplying of electricity to a vehicle of a cableway opens up considerable possibilities for improving passenger safety and/or comfort. For example, it can be envisaged when the vehicles passes in the vicinity of the first pylon after the boarding terminal to take advantage of the electric signal to feed an electronic device on board the vehicle which emits a sound signal reminding the passenger of some safety rules such as lowering the safety rail. At the same time, a message warning the passenger that the disembarking terminal is being approached could be triggered when the vehicle passes in the vicinity of the last pylon.

In one particularly advantageous embodiment, the invention concerns a cableway installation equipped with a retaining system comprising at least one magnetic member arranged on a chair of a vehicle and designed to cooperate with a magnetisable element worn by a passenger who has taken a seat on the chair, so as to retain the passenger when the chair is travelling outside a disembarking point and to release the said passenger when the chair passes through the disembarking point. Provision is also made so that the mobile electric conductor is connected to the magnetic member, and the fixed electric conductor is arranged at the disembarking point so that the mobile conductor comes into contact with the fixed electric conductor when the chair enters the disembarking point and energises the magnetic member so as to set up an electromagnetic field which opposes the field of the magnetisable element.

In this manner the flexible electric contact element, in the event of swinging movement of the chair, is able to compensate for any poor positioning of the first electric coupling means relative to the second electric coupling means.

This type of retaining system can therefore be used for a cableway installation whether or not the chairlifts are detachable.

According to one possibility, the fixed electric conductor comprises a first contact element comprising a plurality of flexible, conductive contact wires in a conductive material arranged on one side of the pathway of the vehicles.

According to another possibility, the fixed electric conductor comprises a first and a second contact element comprising a plurality of flexible contact wires in conductive material arranged facing each other either side of the pathway of the vehicles.

In one embodiment, the wires are made in carbon fibre.

More specifically, the magnetic member comprises a first and a second pole intended to be electrically connected respectively to the first and the second contact element, when the chair passes through the disembarking point or when it passes a pylon or other element on the trajectory of the cableway installation.

According to one first possibility, the magnetic member comprises a first and a second pole, one of said poles being intended to be connected electrically to a single contact element when the chair passes through the disembarking point, the other of said poles being earthed for example via a metal frame of the chair or via a metal cable carrying the chair.

In one embodiment, the installation comprises a sleeve in insulating material, intended to be mounted on a linking arm of the chair, on whose outer side at least one conductor is arranged and electrically connected to the magnetic member, against which the contact element comes to bear that is intended to be fixedly mounted at the disembarking point.

According to one possibility, the magnetic member comprises a permanent magnet capable of retaining the magnetisable element of the passenger, and an electromagnet whose magnetic field, when it is energised, opposes the magnetic field of the permanent magnet.

BRIEF DESCRIPTION OF THE DRAWINGS

For proper understanding of the invention, a description thereof is given with reference to the appended schematic drawing as an example, illustrating one embodiment of this safety system for a cableway installation.

DETAILED DESCRIPTION

Figure 1:
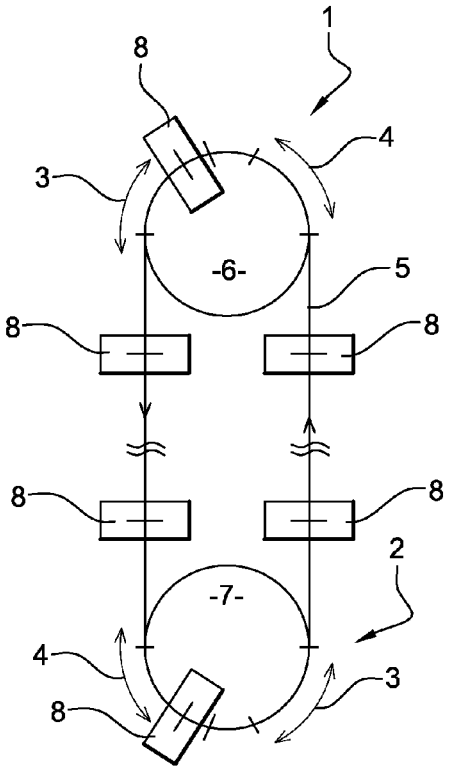
FIG. 1 is a schematic overhead view of a cable installation.

As can be seen in FIG. 1, a cableway installation of chairlift type comprises, as is known per se, at least one terminal generally at high altitude 1 and a terminal generally at low altitude 2, each terminal 1, 2 respectively comprising a boarding point 3 and a disembarking point 4 for passengers. The terminals 1, 2 are linked by an aerial carrier and travel cable 5 forming a closed loop; the cable 5 is driven by pulleys 6, 7. The cable 5 is supported by towers, not illustrated in the figures.

In the most cases, only the boarding point 3 of the lower terminal 2 and only the disembarking point 4 of the upper terminal 1 are used, the cableway being used to travel up the slope. It may sometimes be necessary to use the cableway to travel down the slope.

A plurality of chairs 8, regularly spaced apart, are suspended from a travel cable 5 and fixedly connected thereto. In the example illustrated in the figures, the chairs 8 are not detachable, i.e. they cannot be disengaged from the travel cable 5.

Figure 2:
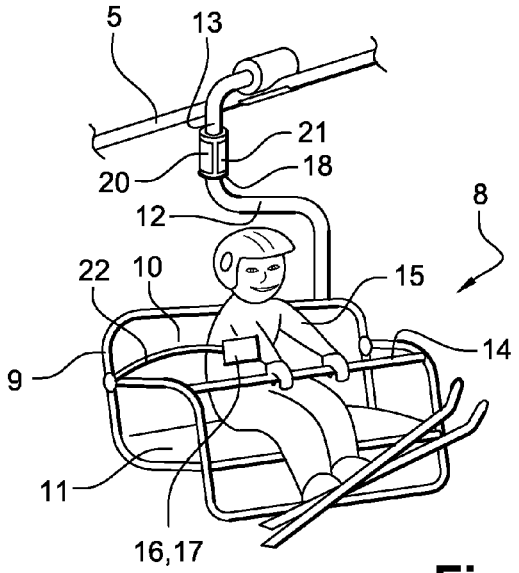
FIG. 2 is a perspective view of a chair equipped with the retaining system according to the invention.

As illustrated FIG. 2, each chair 8 comprises a metal frame 9 forming the chair back 10 and a seat 11, a linking arm 12 used to attach the frame 9 to the travel cable 5. The linking arm 12 comprises a substantially vertical part 13, arranged below and close to the travel cable 5.

A safety rail 14 is pivot mounted on the frame 9; this can be lowered once the passenger or passengers 15 are seated, to prevent the passengers from falling forwards out of the chair 8. The safety rail 14 is lifted when the chair 8 reaches the disembarking point 4 to allow the passengers to leave the chair.

The back 10 of the chair is equipped with a magnetic member 16 which may comprise a permanent magnet and/or an electromagnet. A magnetic member of this type is known from document WO 2007/135256. The electromagnet is designed so that when it is energised it can generate a magnetic field opposing the magnetic field of the permanent magnet.

The passenger is equipped with a magnetisable element 17. By magnetisable element is meant any element which can be magnetised when it is subjected to a magnetic field, in particular by the permanent magnet of the above-mentioned magnetic member 16. The magnetisable element 17 is positioned at the height of the passenger's 15 back. It can either be integrated in the passenger's clothing, or embedded in a protective dorsal bib worn by the passenger.

On the vehicle, a mobile conductor is formed as follows:

A sleeve 18 made in insulating material e.g. synthetic material, is mounted on the vertical zone 13 of the linking arm 12 of the chair 8.

Two conductors 20, 21 in brass of general semi-cylindrical shape are mounted on the outer wall of the insulating sleeve 18. The two conductors 20, 21 are separated from each other so as to form two separate electric contact areas. Each conductor 20, 21 is connected via an electric cable 22 to a pole of the electromagnet. When a voltage is applied between said contact areas 20, 21, the electromagnet is energised and opposes the magnetic attraction of the permanent magnet.

At the each disembarking point 4, the cableway installation comprises a fixed conductor.

Figure 3:
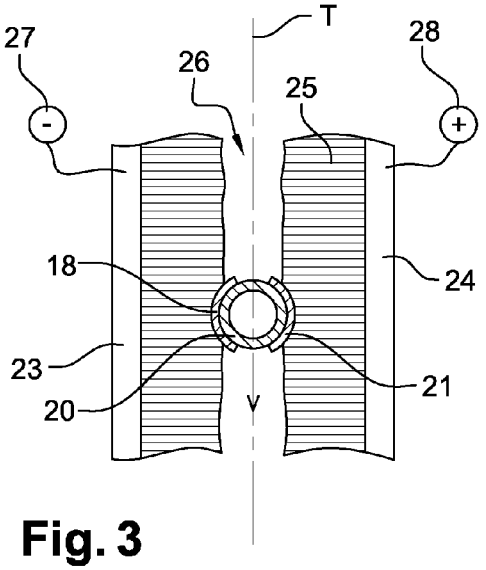
FIG. 3 is a detail of a disembarking point, from an overhead view, equipped with the retaining system.

This fixed conductor is formed of first and second contact elements 23, 24 arranged facing one another, either side of the theoretical trajectory T of the linking arm 12. Each contact element 23, 24, comprises a plurality of flexible, conductive contact wires 25 made of carbon fibre for example. As can be seen in FIG. 3, a space 26 is arranged between the free ends of the wires 25 of each contact element 23, 24.

Each contact element 23, 24 is connected to a pole 27, 28 of a low voltage power supply.

The functioning of the installation is as follows.

At the time of boarding, a passenger 15 waits at the boarding point 4 of the low altitude terminal 2 for the next chairlift 8.

When the chair 8 enters the boarding point 3, the passenger 15 takes a chair seat 11 and leans back flat against the back part 10 of the chair. Since the electromagnet is not supplied with current, the permanent magnet produces a sufficient magnetic field to place the magnetisable element 17 against the magnetic member 16 and to hold it in this position. The passenger 15 is then held against the back part 10 of the chair 8.

As an additional safety measure, the passenger lowers the safety rail 14 and the chair leaves the boarding point 3 and is directed towards the disembarking point 4 at the high attitude terminal 1.

Before the chair 8 reaches this point 4, the passenger lifts up the safety rail 14. The passenger remains held against the chair back 10 by the attraction exerted by the magnetic member 16 on the magnetisable element 17.

When the chair 8 reaches said disembarking point 14, the linking arm 12, more particularly part 13 thereof, enters into the space 26 arranged between the contact wires 25. The free ends of the wires 25 of the contact element 23 come into contact with the contact area 20 and the free ends of the wires 25 of the contact element 24 come into contact with contact area 21. More particularly, the wires 25 can be easily deformed and thereby ensure good electric contact, even if the linking arm 12 is not exactly positioned on its theoretical trajectory T. This is the case in particular when the chair 8 is subjected to swinging movements. The use of contact brushes 23, 24 therefore allows any faulty positioning of the arm to be offset without any risk of deterioration to some of the components of the retaining system.

In this manner, the electromagnet is energised and produces a magnetic field opposing the magnetic field of the permanent magnet. The force required to separate the magnetisable element 17 from the magnetic member 16 is therefore practically zero, even zero.

The passenger 15 is therefore able to get out of the chair 8 and to leave the disembarking point 4.

The retaining system described in the foregoing can also be used for chairlifts comprising detachable chairs.

Figure 4:
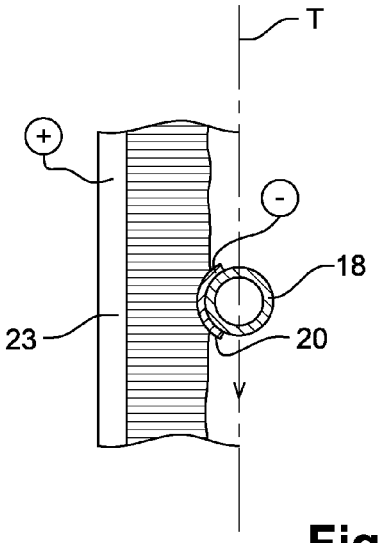
FIG. 4 is a view corresponding to FIG. 3 of a variant of embodiment of the invention.

According to one variant of embodiment of the invention, one of the poles of the electromagnet can be earthed either to the metal frame 9 or to the travel cable 5, the other pole being connected to a single contact area mounted on the insulating sleeve 18. In this case, a single contact brush can be used as is illustrated FIG. 4, or alternatively two brushes connected to one same energising pole.

In addition, the flexible wire or wires can also cooperate with releasing or locking means of the safety rail 14, so that the safety rail 14 is released when the chair 8 enters the disembarking point 4 and the safety rail 14 is locked when the chair leaves this point 4.

The invention is evidently not limited to the sole embodiments of the retaining system described above as examples, but on the contrary encompasses all variants thereof.

It is envisaged in particular to apply the invention to:

the opening and closing of gates, the locking and unlocking of safety rails, the triggering of a light and/or sound message, the supplying of current to electric systems on-board the chair, presence detection.

The invention claimed is:

1. A cableway installation, comprising:

a travel cable;

a vehicle suspended from the travel cable;

a boarding point and a disembarking point;

an aerial carrier configured to support and drive the travel cable such that the vehicle is transported between the boarding point and the disembarking point;

a mobile conductor disposed on the vehicle;

a fixed conductor disposed on the aerial carrier adjacent to the travel cable and in an area proximate to at least one of the boarding point and the disembarking point;

wherein the fixed conductor comprises a first fixed contact element connected to a low voltage electric supply and a first plurality of flexible conductive contact wires extending from the fixed conductor, disposed generally perpendicular to the travel cable, and extending along a longitudinal length of at least one side of the travel cable;

wherein the mobile conductor is disposed so as to the contact the first plurality of flexible conductive contact wires and establish electrical contact with the first fixed contact element and with the low voltage electric supply when the vehicle is transported between the boarding point and the disembarking point.

2. The cableway installation of claim 1, wherein the fixed conductor further comprises:

a second fixed contact element connected to the low voltage power supply; and a second plurality of flexible conductive contact wires extending from the fixed conductor;

wherein the second plurality of flexible conductive contact wires is disposed generally perpendicular to the travel cable and extend along a longitudinal length of a side of the travel cable opposite from the first plurality of flexible conductive contact wires;

wherein the first and second plurality of flexible conductive contact wires delimit a space therebetween through which the mobile conductor is moved when the vehicle is transported such that the mobile conductor contacts the first and second plurality of flexible conductive contact wires and establishes electrical contact with the respective first and second fixed contact element and with the low voltage electric supply.

3. The cableway installation of claim 2, wherein the mobile conductor comprises:

an insulated sleeve disposed on the vehicle;

a first mobile contact element disposed on a first side of the insulated sleeve; and a second mobile contact element disposed on an opposite second side of the insulated sleeve;

wherein the first mobile contact element is disposed to contact the first plurality of flexible conductive contact wires and the second mobile contact element is disposed to contact the second plurality of flexible conductive contact wires when the mobile conductor travels through the space delimited by the first and second plurality of flexible conductive contact wires.

4. The cableway installation of claim 1, further comprising:

a magnetic member in electrical communication with the mobile conductor and disposed in a seat of the vehicle; and a magnetizable element disposed on a passenger and configured to engage with the magnetic member when the passenger sits on the seat;

wherein the magnetic member is configured to be energized by the low voltage power supply when the mobile conductor contacts the fixed conductor such that an electromagnetic field is produced which opposes a field of the magnetizable element.

5. The cableway installation according to claim 4, wherein the magnetic member comprises a first and a second pole, wherein the first pole is electrically connected to the first contact element of the fixed conductor and the second pole is electrically connected to a second contact element of the fixed conductor when the vehicle passes through the disembarking and/or boarding point.

6. The cableway installation according to claim 4, wherein the magnetic member comprises a first and second pole, the first pole being electrically connected to the first fixed contact element when the vehicle passes through the disembarking and/or boarding point, the second pole being connected to, and grounded by, a frame of the vehicle.

7. The cableway installation according to claim 4, wherein the magnetic member comprises a permanent magnet capable of retaining the magnetizable element of the passenger, and an electromagnet whose magnetic field when energized opposes the magnetic field of the permanent magnet.

8. The cableway installation of claim 1, wherein the first plurality of flexible conductive wires are made of a carbon fiber.

9. The cableway installation according to claim 1, further comprising:

a safety rail disposed on a seat of the vehicle moveable between an open position at which a passenger may board and disembark the seat and a closed position at which at passenger is secured within the seat and prevented from boarding and disembarking the seat;

a lock comprising a locked condition in which the safety rail is maintained in the closed position and an unlocked condition in which the safety rail is released and permitted to move into the open position wherein the lock is electrically connected to the mobile conductor and placed into the unlocked condition when energized; and wherein the lock is energized by the low voltage power supply through the fixed and mobile conductors when the vehicle travels through the boarding and disembarking points.

* * * * *